United States Patent [19]

Legallais et al.

[11] Patent Number: 4,597,276

[45] Date of Patent: Jul. 1, 1986

[54] APPARATUS FOR MAKING HELICALLY WOUND INTERLOCKED TUBULAR STRUCTURE

[75] Inventors: Lucien Legallais, Orgeval; Bernard Kuntz, Villemoisson sur Orge, both of France

[73] Assignee: Coflexip, Paris, France

[21] Appl. No.: 678,297

[22] Filed: Dec. 5, 1984

[30] Foreign Application Priority Data

Dec. 6, 1983 [FR] France ..... 83 19474

[51] Int. Cl.[4] ..... B21C 37/12

[52] U.S. Cl. ..... 72/49

[58] Field of Search ..... 72/49, 50, 135, 137, 72/142, 66, 145; 228/145, 146, 147, 148

[56] References Cited

U.S. PATENT DOCUMENTS

| | | | |
|---|---|---|---|
| 1,004,644 | 10/1911 | Gilson | 72/49 X |
| 3,677,046 | 7/1972 | Carroll | 72/49 |
| 4,058,997 | 11/1977 | Siegwart | 72/50 |
| 4,081,981 | 4/1978 | Lipp | 72/49 |

FOREIGN PATENT DOCUMENTS

| | | | |
|---|---|---|---|
| 218149 | 1/1910 | Fed. Rep. of Germany | 72/50 |
| 110576 | 11/1917 | United Kingdom . | |

*Primary Examiner*—E. Michael Combs

*Attorney, Agent, or Firm*—Brisebois & Kruger

[57] ABSTRACT

Apparatus for making a continuous tubular structure of helically wound interlocked metal strip. The metal strip is fed to forming rollers, from a reel of the strip and which are mounted on the same side of a circular plate which is rotated about a horizontal axis to wind the strip, which is shaped by the rollers, prior to winding, around a mandrel. A plurality of pressure rollers positioned around the mandrel interlock and compress the profiled strip. The mandrel is driven in a direction opposite to the direction of rotation of the plate. A rotatable support assembly downstream of the mandrel tightens and clamps the windings. A longitudinal extraction mechanism downstream from the support assembly restrains the tubular structure from rotating and feeds the formed structure to a receiving reel.

7 Claims, 4 Drawing Figures

APPARATUS FOR MAKING HELICALLY WOUND INTERLOCKED TUBULAR STRUCTURE

BACKGROUND OF THE INVENTION

The present invention relates to apparatus for continuously making a continuous helically wound tubular structure of interlocked metal strip.

Applicants' Assignee has developed and marketed for various applications, and especially for undersea petroleum exploitation, flexible tubular pipes and conduits having high mechanical strength characteristics, particularly, resistance to traction, and resistance to both internal and external pressures, particularly, the pressure of hydrocarbons, flowing through the pipes.

Such pipes usually have at least one layer in the form of a tubular structure of interlocked strip wound in a helix, the winding having a basically S- or Z-shaped cross-section allowing mutual interlocking.

Such a tubular structure is thus used in the "rough bore" type of pipe to form the internal carcass of the pipe which constitutes a reinforcement or casing.

In this type of pipe, for certain applications, there may also be used at least one other tubular layer of helical interlocked strip forming a layer designated to reinforce the resistance of the pipe and to internal and external pressures. The helical interlocked strip structure windings are normally separated from the interior casing by a sheath of thermoplastic material. The pipe is generally completed by one or more layers of reinforcing wires or strips and has an exterior thermoplastic sheath for sealing and anti-corrosion protection.

In another type of pipe, called "smooth bore", in which the inside layer is a thermoplastic layer, one or more reinforcing layers each of an interlocked helical wound structure are used.

Interlocked helical wound tubular structures also have applications in other types of flexible or rigid pipes.

There is already known, apparatus to make a long continuous length of an interlocked helical wound tubular structure, this apparatus having a supply of winding strip previously shaped so as to present a basically S- or Z-shaped interlocking section, a fixed winding station having a plurality of pressure fingers to interlock the shaped strip, a mechanism for removing the formed tubular structure, and a reel for its storage. Of course, to form the helical wound tubular structure it is necessary to cause the tubular structure to rotate about its longitudinal axis. To accomplish this, it is necessary to cause the receiving reel for the formed tubular structure to rotate around the longitudinal axis of the formed structure as well as around a transverse axis. The reel must thus be mounted in a frame or casing which is able to turn around the longitudinal axis of the formed tubular structure, means also being provided to make the reel turn in the frame around a transverse axis. In addition, it is necessary to make the withdrawal mechanism turn around the same longitudinal axis of the formed tubular structure, the withdrawal mechanism then being mounted in a turning frame which must be driven in synchronization with the casing or frame containing the receiving reel.

When it is recognized that in order to produce tubular helical wound structures of great length the receiving reels must be several meters in diameter, and the complexity of the device as a result of the need to cause significant masses to turn in synchronization becomes apparent. This complexity is further increased when the tubular structure must be formed around a core, such as a sheath of thermoplastic material or a structure with one or more previously formed layers, because in this case, the core must also rotate around its longitudinal axis, and for this purpose, the reel from which the core unwinds, particularly when the core is flexible, must also be mounted on a support driven in rotation around the longitudinal axis, the rotational movement of this reel naturally being synchronized with the rotational movement of the frame of the receiving reel and the frame of the withdrawal mechanism.

In addition, there is known from British Pat. No. 110,576 apparatus including a circular plate turning around a horizontal axis coincidant with the longitudinal axis of the tubular structure to be formed. This apparatus includes, on the same side of the plate, a support for a supply reel of flat strip, an assembly of driven shaping rollers to drive the strip and to give it a basically S- or Z-shaped cross-section, guiding means for the strip between the supply reel and the assembly of shaping rollers, a tubular mandrel mounted coaxially on the plate near the center of the plate, and an extraction mechanism for longitudinal removal of the tubular structure formed, placed downstream of the turning plate to withdraw the structure formed toward a receiving reel.

In addition to the fact that it was not possible with the prior apparatus to form an interlocked wound strip tubular structures around a core, significant disadvantage of the prior apparatus arose from the impossibility of controlling the interlocking and the tightening of the windings of the shaped strip, at the time of its winding on the mandrel. For each strip, a driven roller only is provided near the mandrel. Such an arrangement does not ensure good tightening of the windings of the strip and, in addition, because of the driving connections between the central roller and the other shaping rollers, it is not possible to easily change the position of the central roller especially when changing from one diameter of manufactured conduit to another.

SUMMARY OF THE INVENTION

The present invention provides apparatus which allows the manufacture of tubular structures and which avoids these disadvantages, and is easily adjustable to form various diameter structures without a central core, as well as around a flexible or rigid central core.

The apparatus according to the invention is characterized by the fact that it includes on a plate a number of pressure idler rollers distributed around a mandrel, preferably near its axial end to ensure the pressing onto the mandrel of the shaped strip coming from the shaping rollers, the hooking or interlocking engagement of the successive windings and the extraction or removal of the structure formed, and that the mandrel is driven in rotation in a direction opposite to the plate and at a speed different from and preferably less than the speed of rotation of the plate, for example, a speed on the order of 10% of the speed of the plate, allowing the mandrel to slip with respect to the strip during winding, in order to avoid seizing of the strip on the mandrel.

According to the invention, the tubular product formed does not rotate about itself, this being obtained in practice by adjusting the speed of rotation of the shaping roller as a function of the speed of rotation of the circular plate and the diameter of the tubular structure formed.

Changes in diameter may be made easily by changing the mandrel and the radial spacing of the pressure idler rollers around the mandrel.

Advantageously, the apparatus also includes, between the plate and the extraction mechanism, an assembly of support members, such as V-shaped shoes or rollers, pressing on the periphery of the structure formed so as to re-tighten the turns of its windings.

Such an assembly of support members is particularly important when the windings of the structure of interlocked strip are formed around a core because such an assembly allows re-tightening of the windings to the diameter of the core. The core is then supplied through an axial opening in the rear of the plate and through the hollow axial interior of the mandrel. In this case it is understood that the supply reel of the core, when this latter is flexible, need not itself be driven in rotation around the longitudinal axis of the plate since the core itself is not driven in rotation.

The assembly of support members, when provided, is mounted on a turning frame rotated at a greater speed of rotation than the plate.

In one advantageous embodiment, the assembly of shaping rollers is mounted on a hinged support on the plate which can be tilted with respect to the plate, the inclination of tilt of the support determining the winding angle of the windings of the strip on the structure formed.

The extraction mechanism can be of any appropriate type, for example, with motorized rollers of or the "trichenille type", this mechanism helping to immobilize rotation of the structure formed.

In order to make the invention better understood, one non-limiting embodiment will now be described as an example, with reference to the accompanying drawings.

DETAILED DESCRIPTION

Figure 2:
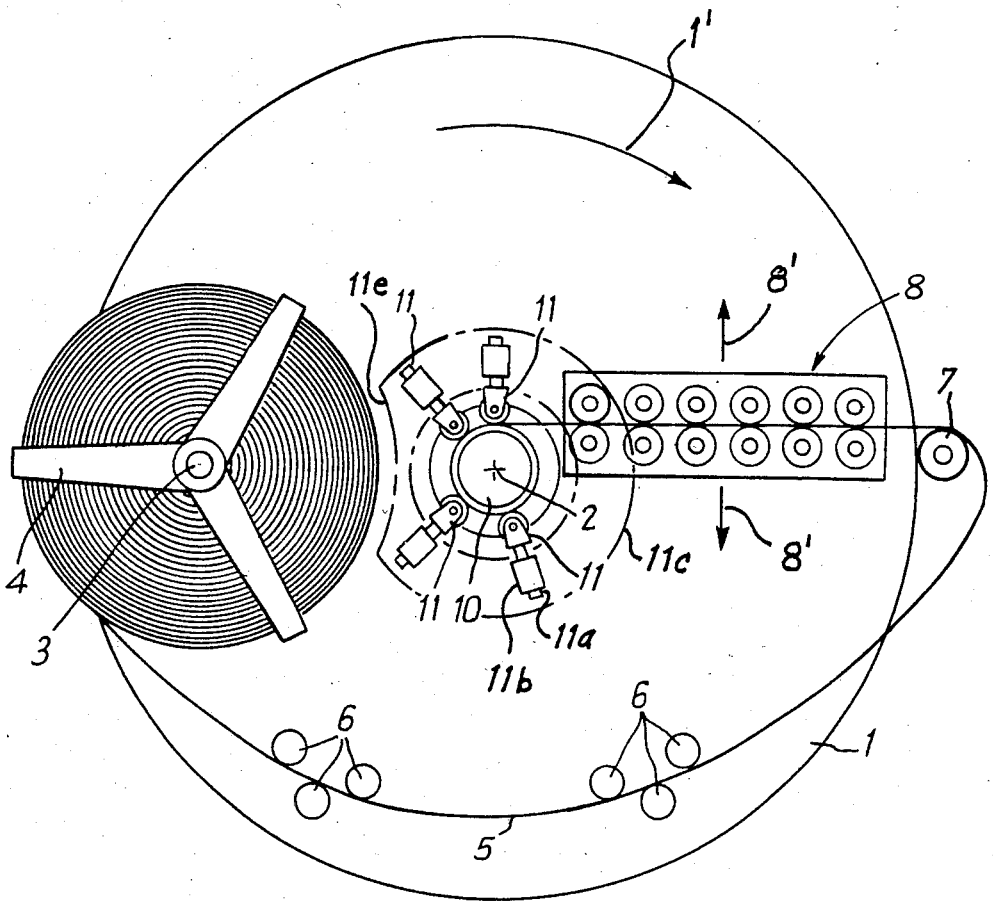
FIG. 2 is a front view of the turning plate.

The apparatus according to the invention shown on the drawings includes a large circular plate 1 driven in rotation in the direction illustrated by the arrow 1' on FIG. 2, around a horizontal axis 2 by driving means including a motor 1*a* having a drive gear which meshes with a ring gear on a hub 1*b* extending from the rearward side of plate 1. A bearing 1*c* supports the plate 1 for rotation.

On its front side or face, various components are mounted on plate 1, and these will be described below.

The plate 1 has a support 3, shown as an axle, for supporting a supply reel 4 of flat winding strip 5.

Figure 4:
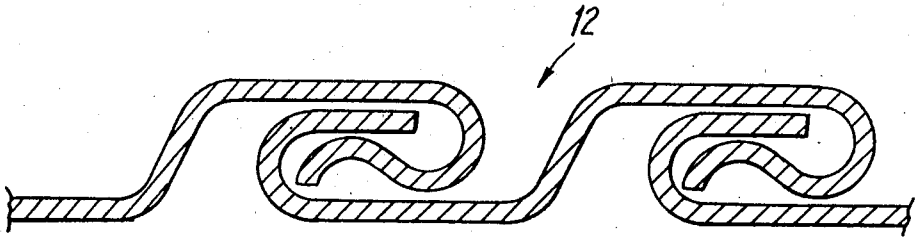
FIG. 4 is a greatly enlarged view in section taken along line IV—IV of FIG. 1, and showing the structure of the interlocked windings of the tubular structure which is formed.

The flat winding strip 5, as best seen on FIG. 2, unwinds from reel 4, is guided by the assemblies of guiding rollers 6, then by a return mechanism 7 to an assembly 8 of shaping rollers, which form the strip to the essentially S- or Z-shaped cross-section, shown at FIG. 4.

Assembly 8 is comprised of two blocks or units each having, in the example shown, six motor driven shaping rollers. The blocks or units can be separated from each other in the direction of the arrows 8' shown at FIG. 2. Moreover, the assembly 8 can be displaced or adjusted in translation (or angularly) in the plane of the plate so that the strip passing through the roller assembly 8 is fed along a straight line tangentially with respect to the exterior surface of the mandrel 10. In addition, the assembly 8 of shaping rollers is mounted on a support table 9 (FIGS. 1 and 3) pivotally connected to plate 1 and which can be tilted or inclined with respect to the plane of plate 1 at selected variable angles $\alpha$, the inclination of support 9 to plate 1 determining the helix angle of the windings formed, as can be best seen at FIG. 3. An adjusting screw (not shown) can be provided between support table 9 and plate 1 to adjust the angle $\alpha$.

Figure 3:
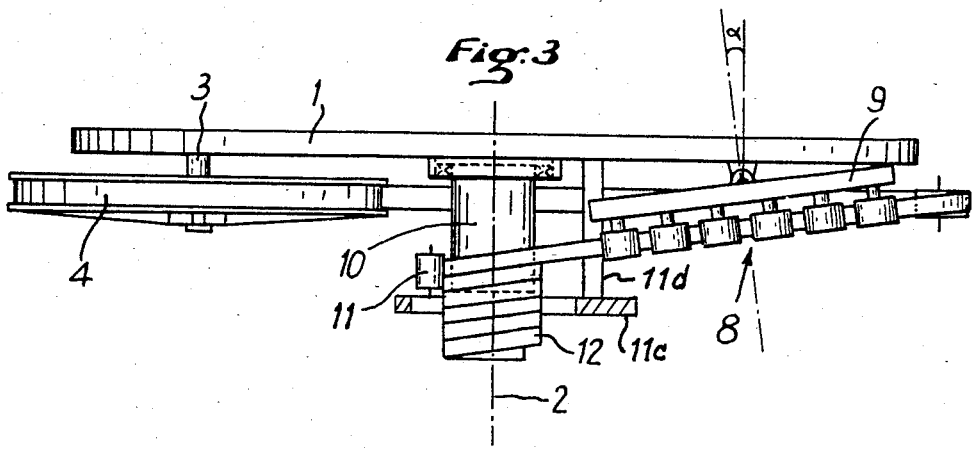
FIG. 3 is a view from above of the apparatus of FIG. 2.

Mounted on plate 1, near its center and coaxial with the axis of rotation 2, is a tubular mandrel 10 around which the strip 5 is helically wound. Mandrel 10 is driven in rotation, in a direction opposite to the direction of rotation of plate 1 and at a speed less than the speed of rotation of the plate. The speed of rotation of mandrel 10 is, for example, on the order of 10% of the rotational speed of the plate 1. As shown at FIG. 3, a bearing 10' mounts the mandrel 10 on the plate 1 for rotation relative to the plate. The mandrel 10 is rotated by a motor 10*a* having a gear 10*b* which meshes with a ring gear 10*c* on a rearward extension 10*d* of the mandrel.

Figure 1:
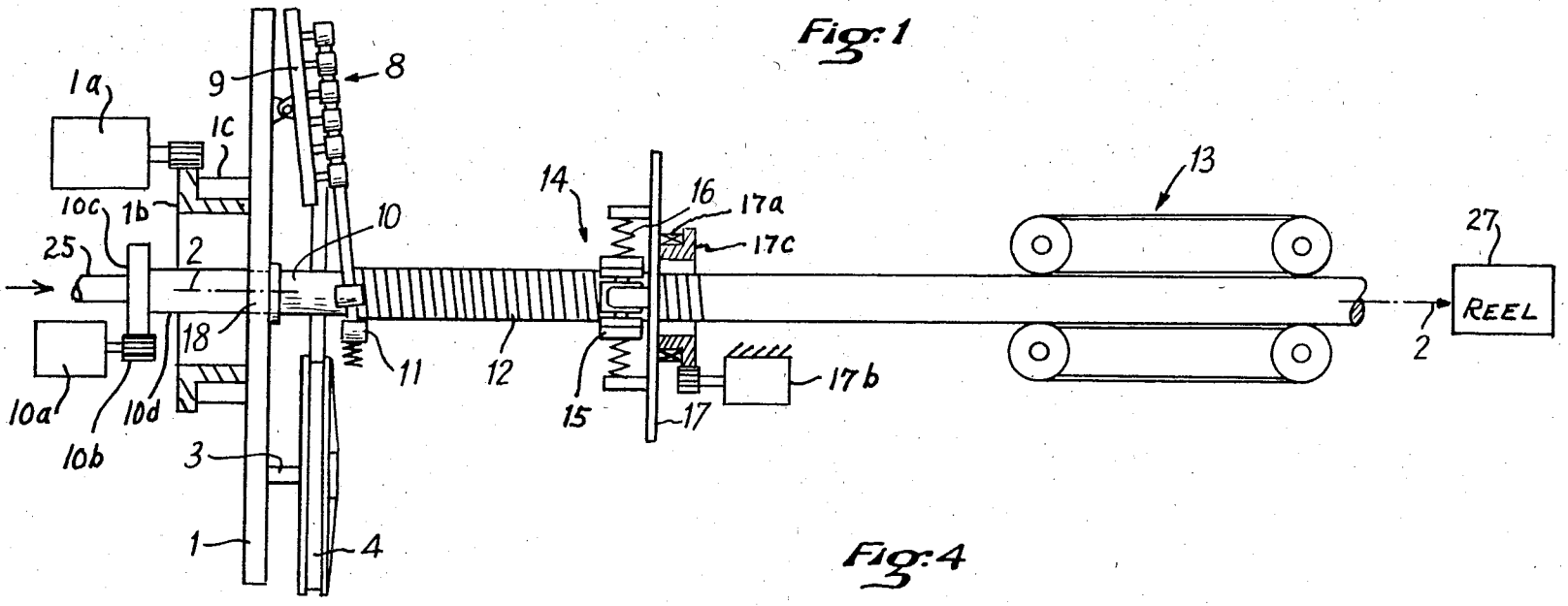
FIG. 1 is a schematic view in elevation of an apparatus according to the invention.

As shown at FIGS. 1–3, the shaped or profiled strip 5 coming from the forming roller assembly 8 is pressed against the periphery of mandrel 10 by a plurality of pressing idler rollers 11 spaced around mandrel 10. Rollers 11 are spring pressed against the profiled strip and assure interlocking of the successive turns of the winding formed, and clamping or fastening of the turns together. The rollers 11 also tend to drive the helically wound structure axially from the mandrel 10.

As shown at FIG. 2, each roller 11 has a support shaft 11*a* which extends into a support block 11*a* . The support blocks 11*b* are mounted on a support ring 11*c* (shown in phantom lines at FIG. 2). Support ring 11*c* is secured to plate 1 by mounting bars 11*d*. The mounting ring can have radial slots to facilitate radial adjustment of the positions of the rollers relative to mandrel 10. Portions of the support ring 11*c* can be recessed or cut away as shown at 11*e* to avoid interference with other components mounted on the front side of plate 1.

The helical tubular structure 12 of interlocked wound strip thus formed is removed axially by a longitudinal extraction mechanism 13, of the "trichenille type" (which includes opposed belts or traction tracks) and restrains the formed tubular structure from rotating. The extractor mechanism 13 also helps control the pitch of the winding.

In the example shown, the apparatus also has, between plate 1 and extraction mechanism 13, an assembly of support members 14 including V-shaped support shoes 15, constrained by springs 16. The support shoes 15 are mounted on a support plate 17 which is supported for rotation around longitudinal axis 2, by a bearing 17*a*. The support plate 17 is driven by a motor 17*b* having a gear which meshes with a ring gear on a hollow hub 17*c* of the support plate. The speed of rotation of support plate 17 is greater than the speed of rotation of plate 1, and the support plate turns in the same direction as plate 1. The apparatus can be used to make a casing of helically wound interlocked strip without an interior core, and can also be used to make a casing with an interior core.

When such a core 25 is desired, it is fed in the direction of the arrow 26' (FIG. 1), through the rearward extension 10*d* of the hollow mandrel and thus through the axial opening 18 of plate 1, concentric with axis 2. The core 25 does not rotate and therefore, its supply reel need not rotate about axis 2.

To make a wound casing, the initial turns are wound on the mandrel. When the windings have reached extraction mechanism 13, this mechanism pulls the formed casing at a speed proportional to the speed of rotation of plate 1, allowing continuous forming of a tubular structure of helically wound interlocked strip. The formed tubular structure is wound on a receiving reel 27 located downstream of the extraction mechanism.

Although the invention has been described in connection with a particular embodiment of the invention, it is, of course, in no way thereby limited and numerous variations and modifications can be made without departing from its scope or its spirit.

We claim:

1. Apparatus for making a continuous tubular structure of interlocked helically wound strip comprising, a circular plate driven in rotation in one direction around a horizontal axis substantially coinciding with the longitudinal axis of the tubular structure which is formed, said plate having a first side and a second side, support means mounted on said first side of the plate for supporting a supply reel of flat strip, an assembly of driven shaping rollers mounted on said first side of the plate to drive the strip and to form the flat strip into a profiled strip of basically S- or Z-shaped cross-section, means mounted on said first side of the plate between the supply reel and the assembly of shaping rollers for guiding the flat strip from the reel to the shaping rollers, a tubular mandrel coaxial with and on said first side of the plate and onto which the profiled strip from the shaping rollers is helically wound, means for rotating the mandrel in a direction opposite to the direction of rotation of the circular plate, longitudinal extraction means positioned downstream of the plate for withdrawing the tubular structure as it is formed, and for directing the formed structure toward a receiving station downstream of the extraction means, and a plurality of idler pressure rollers mounted on said first side of the plate and circumferentially spaced around said mandrel, said pressure rollers pressing the profiled strip from the shaping rollers against the mandrel, said pressure rollers further pressing against the helically wound profiled strip to interlock successive turns of the strip and to drive the helically wound structure axially in a direction downstream of the circular plate.

2. Apparatus according to claim 1, wherein the assembly of driven shaping rollers is mounted on a support pivoted to said circular plate for tilting movement relative to the plane of the circular plate.

3. Apparatus according to claim 1, further comprising between said plate and said extraction means, an assembly of support members pressing on the periphery of the structure formed to compress and tighten the turns of the structure.

4. Apparatus according to claim 3, wherein said assembly of support members comprises a plurality of V-shaped shoes which extend around the periphery of the wound tubular structure.

5. Apparatus according to claim 3 comprising means for rotating said assembly of support members at a speed of rotation greater than the speed of rotation of the circular plate.

6. Apparatus according to claim 1 for making a helically wound tubular structure of interlocked strip around an inner tubular sheath, wherein said mandrel comprises a hollow mandrel, and means for feeding a sheath without rotation about its axis from the second side of the plate axially through an axial opening in said plate and through said hollow mandrel.

7. Apparatus according to claim 1 wherein, said means for rotating said mandrel comprises, means for rotating said mandrel at a speed of about 10% of the speed of rotation of the circular plate.

* * * * *